US011294295B2

(12) United States Patent
Hiraide

(10) Patent No.: US 11,294,295 B2
(45) Date of Patent: Apr. 5, 2022

(54) DEVELOPER, IMAGE FORMING UNIT, IMAGE FORMING APPARATUS, AND METHOD OF MANUFACTURING DEVELOPER

(71) Applicant: Oki Data Corporation, Tokyo (JP)

(72) Inventor: Manami Hiraide, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/788,784

(22) Filed: Feb. 12, 2020

(65) Prior Publication Data

US 2020/0310290 A1 Oct. 1, 2020

(30) Foreign Application Priority Data

Mar. 27, 2019 (JP) ..... JP2019-061057

(51) Int. Cl.
*G03G 9/00* (2006.01)
*G03G 9/09* (2006.01)
*G03G 15/08* (2006.01)

(52) U.S. Cl.
CPC ..... *G03G 9/0902* (2013.01); *G03G 15/0865* (2013.01)

(58) Field of Classification Search
CPC ..... G03G 9/0902
See application file for complete search history.

(56) References Cited

U.S. PATENT DOCUMENTS 9,557,674 B2 * 1/2017 Hirai ..... G03G 9/08782
2005/0214666 A1 * 9/2005 Schulze-Hagenest ..... G03G 9/09716 430/108.2
2005/0255402 A1 * 11/2005 Hopper ..... G03G 9/0804 430/137.14
2011/0165511 A1 * 7/2011 Zhu ..... G03G 9/0806 430/137.15
2013/0323633 A1 * 12/2013 Takahashi ..... G03G 9/0819 430/105
2014/0234765 A1 8/2014 Hirai et al.
2015/0064615 A1 3/2015 Hirai et al.
2015/0111140 A1 4/2015 Noguchi et al.
2015/0192872 A1 * 7/2015 Noguchi ..... G03G 9/0902 430/105

FOREIGN PATENT DOCUMENTS

EP 3276421 A1 1/2018
JP 2018-163305 A 10/2018

* cited by examiner

*Primary Examiner* — Mark A Chapman
(74) *Attorney, Agent, or Firm* — Rabin & Berdo, P.C.

(57) ABSTRACT

A developer includes a metallic pigment and a binder resin. The developer includes a fine powder having a particle size smaller than a mode value in a volume particle size distribution of the metallic pigment. A proportion of the fine powder relative to the developer is equal to or higher than 4.6 percent and equal to or lower than 9.6 percent.

20 Claims, 6 Drawing Sheets

| | | FINE POWDER PROPORTION [%] | FINE POWDER PROPORTION AFTER REMOVAL OF EXTERNAL ADDITIVE [%] | VOLUME MEDIAN PARTICLE SIZE [μm] | AMOUNT OF ELECTRIC CHARGE [−μC/g] | FOGGING | STREA-KING | BRILLIANCE | |
|---|---|---|---|---|---|---|---|---|---|
| | | | | | | | | FI VALUE | EVALU-ATION |
| EXAMPLE 1 | DEVELOPER Da | 9.6 | 7.5 | 15.4 | 10.5 | ○ | ○ | 13.1 | ○ |
| EXAMPLE 2 | DEVELOPER Db | 9.5 | 9.6 | 16.9 | 12.2 | ○ | ○ | 23.9 | ○ |
| EXAMPLE 3 | DEVELOPER Dc | 9.2 | 7.1 | 15.9 | 11.1 | ○ | ○ | 13.1 | ○ |
| EXAMPLE 4 | DEVELOPER Dd | 4.6 | 3.1 | 16.1 | 10.6 | ○ | ○ | 10.6 | ○ |
| COMPARATIVE EXAMPLE 1 | DEVELOPER De | 10.3 | 11.7 | 14.4 | 10.9 | ○ | × | 5.6 | × |
| COMPARATIVE EXAMPLE 2 | DEVELOPER Df | 2.0 | 1.8 | 18.7 | 6.8 | × | ○ | 16.0 | ○ |

FIG. 5

| | | ALUMINUM (Al) CONTENT [%] | RESIN ($CH_2O$) CONTENT [%] | RATIO OF Al TO RESIN |
|---|---|---|---|---|
| EXAMPLE 1 | DEVELOPER Da | 11.202 | 87.199 | 0.13 |
| EXAMPLE 2 | DEVELOPER Db | 16.738 | 81.606 | 0.21 |
| EXAMPLE 3 | DEVELOPER Dc | 19.074 | 78.724 | 0.24 |
| EXAMPLE 4 | DEVELOPER Dd | 21.473 | 76.294 | 0.28 |
| COMPARATIVE EXAMPLE 1 | DEVELOPER De | 7.019 | 91.485 | 0.08 |
| COMPARATIVE EXAMPLE 2 | DEVELOPER Df | 16.702 | 81.625 | 0.20 |
| FINE POWDER ONLY | | 0.925 | 96.143 | 0.01 |

DEVELOPER, IMAGE FORMING UNIT, IMAGE FORMING APPARATUS, AND METHOD OF MANUFACTURING DEVELOPER

CROSS-REFERENCE TO RELATED APPLICATIONS

The present application claims priority from Japanese Patent Application No. 2019-061057 filed on Mar. 27, 2019, the entire contents of which are hereby incorporated by reference.

BACKGROUND

The technology relates to a developer, an image forming unit, an image forming apparatus, and a method of manufacturing a developer. The technology may be suitably applied to an electrophotographic printer, for example.

An image forming apparatus has been in widespread use that performs a printing process by causing an image forming unit to form a developer image with the use of a developer on the basis of an image supplied from, for example, a computer device, transferring the formed developer image onto a medium such as paper, and applying heat and pressure to the medium to fix the developer image thereto.

Non-limiting examples of the image forming apparatus may include a printer. Non-limiting examples of the developer may include a toner. Non-limiting examples of the developer image may include a toner image.

The image forming apparatus may use developers of such colors as cyan, magenta, yellow, and black in a case of performing typical color printing, for example. The colors of cyan, magenta, yellow, and black are hereinafter referred to as usual colors. The developers each contain, in addition to a pigment of the corresponding color, a binder resin directed to binding the pigment to a medium, various external additives, or any other suitable material, for example.

Furthermore, the image forming apparatus sequentially attaches developers to each roller in an image forming unit or a medium such as a sheet of paper and transfers the developers thereto with the use of static electricity, or specifically, by appropriately applying a predetermined high voltage, to each roller or any other member in the image forming unit. Therefore, the developers need a certain degree of electrifiable property. Accordingly, there is a developer whose electrifiable property is adjusted to an appropriate value through a technique such as increasing an amount of an external additive having an electrifiable property or increasing an amount of an electrification inhibitor to be added to a binder resin, for example (see, for example, FIG. 1, etc. of Japanese Unexamined Patent Application Publication No. 2018-163305).

SUMMARY

There is a developer that contains a metallic pigment for the purpose of providing brilliance. Such a metallic pigment has a sufficiently larger particle size than a pigment of a usual color. Therefore, a particle that includes such a metallic pigment and a binder resin has a particle size that is sufficiently larger than the particle size of a toner of a usual color. The particle that includes the metallic pigment and the binder resin is also referred to below as a toner.

As compared with a developer of the usual color, a developer including such a metallic pigment has a relatively small surface area per unit weight because of its larger particle size, which leads to its lower electrifiable property. In a case where such a developer with a low electrifiable property is used in an image forming apparatus, a phenomenon called "fogging" can occur, where the developer adheres to a margin or a background of an image to which the developer is not supposed to adhere to decrease image quality.

In a case where the electrifiable property is to be enhanced by increasing an amount of an external additive in a toner with a metallic pigment, a large amount of external additive is required. In a case where a developer to which a large amount of external additive is added is used, however, a portion of the external additive is freed to contaminate a component, such as a photosensitive drum or a developing blade, within an image forming unit in the image forming apparatus. This degrades the quality of an image to be printed on a medium such as a sheet of paper in the end, that is, degrades print quality.

Furthermore, with regard to a developer including a metallic pigment, in a case where a dissolution suspension method is adopted, it is difficult to make a particle contain the metallic pigment through a technique of increasing an amount of an electrification controlling agent. This can lead to a concern that it is difficult not possible to manufacture the developer including the metallic pigment. The metallic pigment is also referred to as a brilliant pigment.

In this manner, it is difficult to sufficiently increase the electrifiable property of a developer containing a metallic pigment, and there has been a concern that the print quality of an image forming apparatus that uses such a developer can be degraded.

It is desirable to provide a developer that contains a metallic pigment but still allows for high print quality, to provide an image forming unit and an image forming apparatus in which such a developer is used, and to provide a method of manufacturing such a developer.

According to one embodiment of the technology, there is provided a developer that includes a metallic pigment and a binder resin. The developer includes a fine powder having a particle size smaller than a mode value in a volume particle size distribution of the metallic pigment. A proportion of the fine powder relative to the developer is equal to or higher than 4.6 percent and equal to or lower than 9.6 percent.

According to one embodiment of the technology, there is provided a developer that includes a metallic pigment, a binder resin, and an external additive. The developer includes a fine powder having a particle size smaller than a mode value in a volume particle size distribution of the metallic pigment. A proportion of the fine powder relative to the developer in the volume particle size distribution held when the external additive is removed from the developer is equal to or higher than 3.1 percent and equal to or lower than 9.6 percent.

According to one embodiment of the technology, there is provided an image forming unit that includes a photosensitive member, an exposure unit, and a developing member. The photosensitive member is subjected to exposure in response to light irradiation. The exposure unit performs exposure on the photosensitive member and thereby forms an electrostatic latent image. The developing member generates a developer image on the photosensitive member with use of the developer. The developer image is based on the electrostatic latent image. The developer includes a metallic pigment and a binder resin. The developer includes a fine powder having a particle size smaller than a mode value in a volume particle size distribution of the metallic pigment.

A proportion of the fine powder relative to the developer is equal to or higher than 4.6 percent and equal to or lower than 9.6 percent.

According to one embodiment of the technology, there is provided an image forming apparatus that includes an image forming unit and a fixing section that fixes a developer image generated by the image forming unit to a medium. The image forming unit includes a photosensitive member, an exposure unit, and a developing member. The photosensitive member is subjected to exposure in response to light irradiation. The exposure unit performs exposure on the photosensitive member and thereby forms an electrostatic latent image. The developing member generates the developer image on the photosensitive member with use of the developer. The developer image is based on the electrostatic latent image. The developer includes a metallic pigment and a binder resin. The developer includes a fine powder having a particle size smaller than a mode value in a volume particle size distribution of the metallic pigment. A proportion of the fine powder relative to the developer is equal to or higher than 4.6 percent and equal to or lower than 9.6 percent.

According to one embodiment of the technology, there is provided a method of manufacturing a developer by a dissolution suspension method, the method including preparing a resin solution that causes at least a metallic pigment and a binder resin to be dispersed in an organic solvent. The developer includes a fine powder having a particle size smaller than a mode value in a volume particle size distribution of the metallic pigment. A proportion of the fine powder relative to the developer is equal to or higher than 4.6 percent and equal to or lower than 9.6 percent.

In the embodiment of the technology, the fine powder is contained in the developer at a proportion of equal to or higher than 4.6% and equal to or lower than 9.6%. The fine powder includes few metallic pigments since the fine powder has a particle size smaller than the mode value in the volume particle size distribution of the metallic pigment. Therefore, in the embodiment of the technology, it is possible to enhance the electrifiable property of the developer which is difficult to obtain sufficient electrifiable property due to the metallic pigments included therein. This enhancement is achieved by the presence of the fine powder that includes few metallic pigments and therefore has a sufficient electrifiable property. Thereby, the use of the developer in the image forming unit of the image forming apparatus makes it possible to form or print a high-quality image on a medium with no fogging.

BRIEF DESCRIPTION OF THE DRAWINGS

FIG. 5 is a table summarizing results from measuring and evaluating each developer.

DETAILED DESCRIPTION

Figure 1:
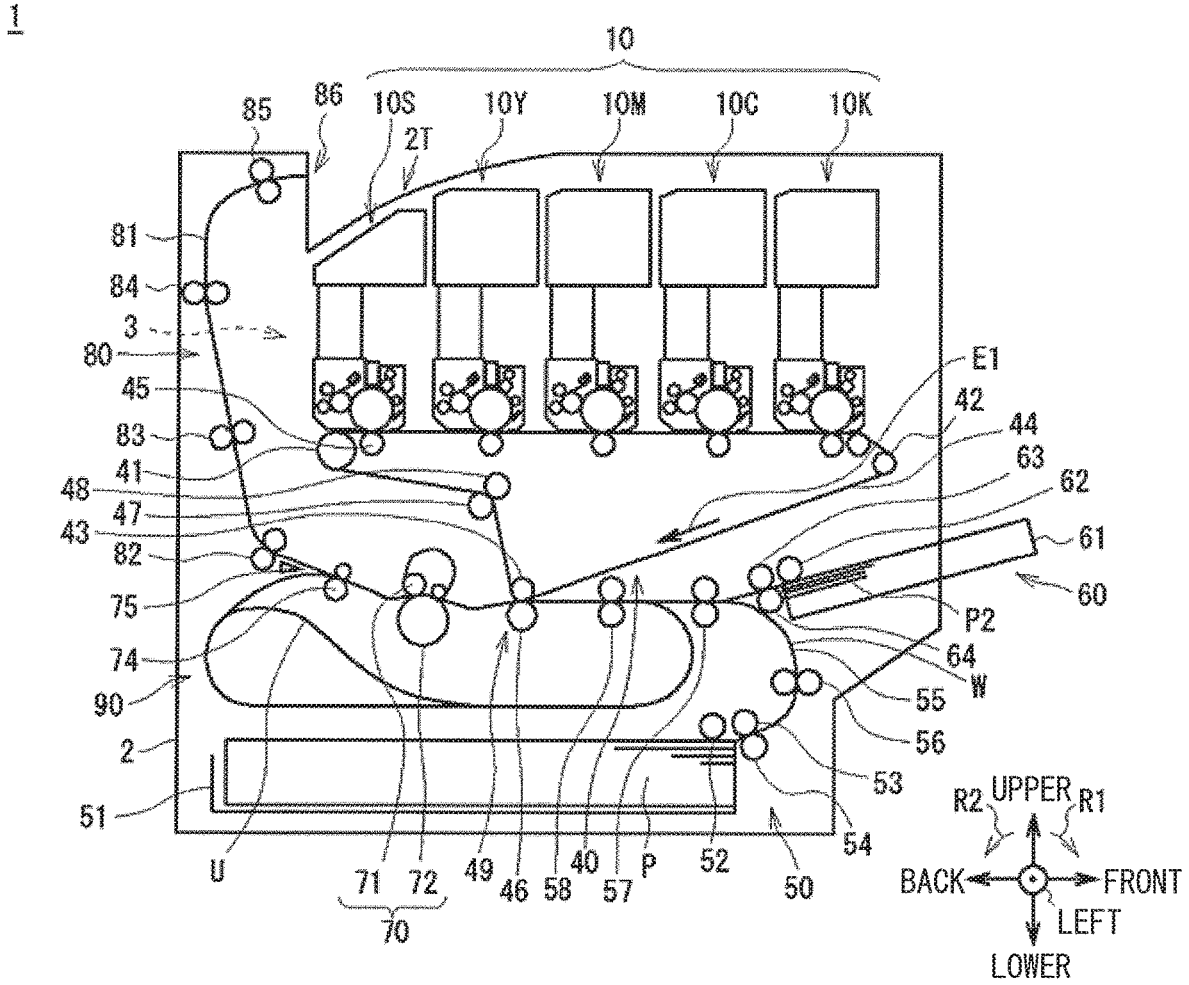
FIG. 1 is a schematic diagram illustrating an example of a configuration of an image forming apparatus.

Hereinafter, some example embodiments of the technology will be described with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Configuration of Image Forming Apparatus

As illustrated schematically in a side view of FIG. 1, an image forming apparatus 1 according to an example embodiment of the technology may be an electrophotographic color printer. The image forming apparatus 1 may be able to form or print a color image on a medium. Non-limiting examples of the medium may include a sheet of paper, i.e., a paper sheet P. The image forming apparatus 1 may not have, for example, an image scanner function of reading a document or a communication function that uses a phone circuit. The image forming apparatus 1 may be a single function printer (SFP) having only a printer function.

In the image forming apparatus 1, various components may be disposed inside a housing 2. The housing 2 may have an approximately box-like shape. In the following description, a right end portion in FIG. 1 is defined as front side of the image forming apparatus 1. An upper-lower direction, a right-left direction, and a front-back direction are each defined as a direction perceived by one facing the front side.

The image forming apparatus 1 may include a controller 3. The controller 3 may generally control the image forming apparatus 1 as a whole. The controller 3 may include, for example but not limited to, an unillustrated central processing unit (CPU), an unillustrated read-only memory (ROM), and an unillustrated random-access memory (RAM). The controller 3 may execute various processes by reading out and executing a predetermined program. The controller 3 may be coupled to an unillustrated host device wirelessly or with a cable. The host device may be, for example but not limited to, a computer device. When the controller 3 is provided with image data representing an image to be printed from the host device and instructed to print the provided image data, the controller 3 may execute a printing process of forming a print image on a surface of a paper sheet P which is a non-limiting example of the medium.

In an upper portion inside the housing 2, five image forming units 10K, 10C, 10M, 10Y, and 10S may be disposed in this order from the front side toward the back side. The image forming units 10K, 10C, 10M, 10Y, and 10S may respectively correspond to black (K), cyan (C), magenta (M), yellow (Y), and a special color (S). The image forming units 10K, 10C, 10M, 10Y, and 10S may differ from one another only in terms of their colors and may all have similar configurations.

Black (K), cyan (C), magenta (M), and yellow (Y) may each be a color used in a typical color printer. These colors may be referred to below as usual colors. In contrast, non-limiting examples of the special color (S) may include white, a clear which may be transparent or colorless, and silver. For the convenience of description, the image forming units 10K, 10C, 10M, 10Y, and 10S may also be referred to collectively as image forming units 10 in the following description.

Figure 2:
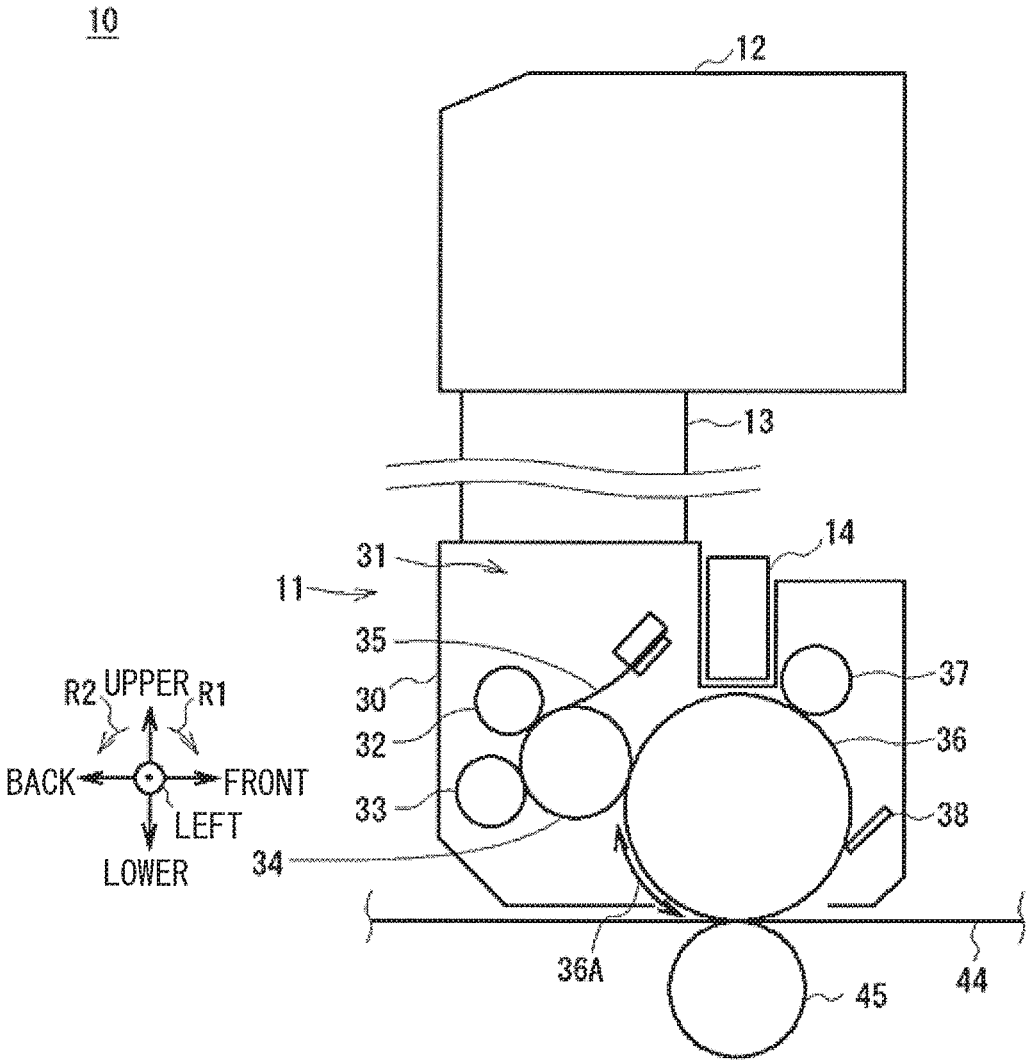
FIG. 2 is a schematic diagram illustrating an example of a configuration of an image forming unit.

As illustrated in FIG. 2, the image forming unit 10 may mainly include an image forming main body 11, a developer container 12, a developer feeder 13, and a light emitting diode (LED) head 14. The image forming unit 10 and components of the image forming unit 10 may have a sufficient length in the right-left direction in accordance with the length of the paper sheet P in the right-left direction. Therefore, many of the components may be relatively longer in the right-left direction than in the front-back direction or in the upper-lower direction. Thus, these components may each have a shape elongated in the right-left direction.

The developer container 12 may contain a developer therein. The developer container 12 may be attachable to and detachable from the image forming unit 10. When the developer container 12 is to be mounted to the image forming unit 10, the developer container 12 may be attached to the image forming main body 11 with the developer feeder 13 interposed therebetween.

Figure 3:
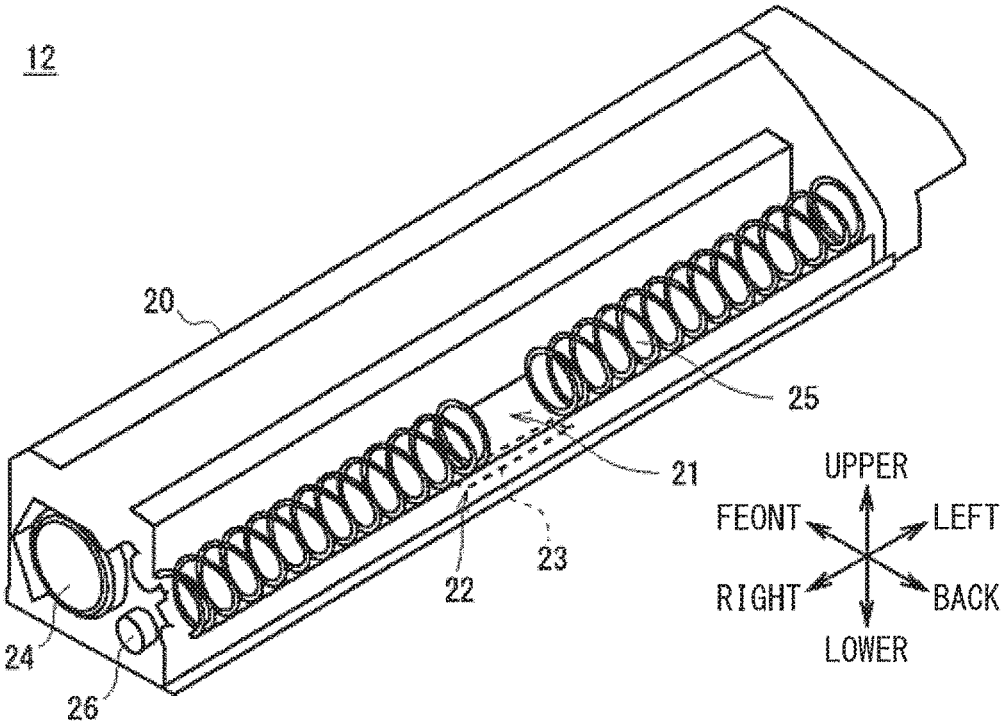
FIG. 3 is a schematic perspective view of an example of a configuration of a developer container.

As illustrated in the schematic perspective view in FIG. 3, the developer container 12 may include a containing chamber 21 inside a container housing 20. The containing chamber 21 may contain a developer D. The container housing 20 may be longer in the right-left direction. The containing chamber 21 may be a cylindrical space that is longer in the right-left direction. The developer container 12 is also referred to as a toner cartridge in some cases.

A feeding hole 22 may be provided in a bottom portion of the containing chamber 21 at an approximate middle in the right-left direction. The feeding hole 22 may allow for communication between a space inside the containing chamber 21 and a space outside thereof. In addition, a shutter 23 may also be provided in the bottom portion of the containing chamber 21 at the approximate middle in the right-left direction. The shutter 23 may allow the feeding hole 22 to be open or closes the feeding hole 22. The shutter 23 may be coupled to a lever 24, which causes the shutter 23 to allow the feeding hole 22 to be open or close the feeding hole 22 in accordance with pivoting of the lever 24. The lever 24 may be operated by a user when the developer container 12 is attached to or detached from the image forming unit 10.

For example, the feeding hole 22 in the developer container 12 may be closed by the shutter 23 in a state held before the developer container 12 is mounted to the image forming unit 10 illustrated in FIG. 2. The developer D contained inside the containing chamber 21 may be thereby prevented from leaking to the outside. In a case where the developer container 12 is to be mounted to the image forming unit 10, the shutter 23 may be moved to allow the feeding hole 22 to be open by pivoting of the lever 24 in a predetermined opening direction. With this operation, the developer container 12 may allow for communication between the space inside the containing chamber 21 and the space inside the developer feeder 13. The developer container 12 may be thereby able to feed the developer D in the containing chamber 21 to the image forming main body 11 via the developer feeder 13. When the developer container 12 is to be removed from the image forming unit 10, the shutter 23 may be moved to close the feeding hole 22 by pivoting of the lever 24 in a predetermined closing direction.

A stirring member 25 may be provided inside the containing chamber 21. The stirring member 25 may have a shape of an elongated member spirally wound about an imaginary center axis extending in the right-left direction. The stirring member 25 may rotate about the imaginary center axis inside the containing chamber 21. A stir driving portion 26 may be provided at an end of the container housing 20. The stir driving portion 26 may be linked to the stirring member 25. Upon being supplied with a driving force from a predetermined driving force source provided in the housing 2 illustrated in FIG. 1, the stir driving portion 26 may transmit the driving force to the stirring member 25 to cause the stirring member 25 to rotate. With this operation, the developer container 12 may stir the developer D contained in the containing chamber 21. The developer D may be thereby prevented from coagulating to be sent to the feeding hole 22.

As illustrated in FIG. 2, the image forming main body 11 may include an image forming housing 30, a developer containing space 31, a first feeding roller 32, a second feeding roller 33, a developing roller 34, a developing blade 35, a photosensitive drum 36, a charging roller 37, and a cleaning blade 38 that are assembled in the image forming main body 11. Of these components, the first feeding roller 32, the second feeding roller 33, the developing roller 34, the photosensitive drum 36, and the charging roller 37 may each have a columnar shape having its center axis extending in the right-left direction and may each be rotatably supported by the image forming housing 30.

In the image forming unit 10S of the special color (S), the developer container 12 containing a developer D of a color, e.g., white, clear, silver, etc., selected in advance by the user may be mounted to the image forming main body 11 with the developer feeder 13 interposed therebetween.

The developer containing space 31 may contain the developer fed from the developer container 12 via the developer feeder 13. The first feeding roller 32 and the second feeding roller 33 may each include an elastic layer formed on its peripheral side surface. The elastic layer may include, for example but not limited to, an electrically-conductive urethane rubber foam. The developing roller 34 serving as a developing member may include, for example but not limited to, an elastic layer having elasticity or a conductive surface layer provided on its peripheral side surface. The developing blade 35 may include a stainless steel plate having a predetermined thickness, for example. The developing blade 35 may be partially in contact with the peripheral side surface of the developing roller 34 while being elastically deformed slightly.

The photosensitive drum 36 may include a thin-film-shaped electric charge generating layer and a thin-film-shaped electric charge transfer layer successively provided on its peripheral side surface. The photosensitive drum 36 may thereby configured to be electrically charged. The charging roller 37 may have its peripheral side surface covered with a conductive elastic member. The peripheral side surface of the charging roller 37 may be in contact with the peripheral side surface of the photosensitive drum 36. The cleaning blade 38 may include a thin-plate-shaped resin, for example. The cleaning blade 38 may be partially in contact with the peripheral side surface of the photosensitive drum 36 while being elastically deformed slightly.

The LED head 14 may be positioned on the upper side of the photosensitive drum 36 in the image forming main body 11. In the LED head 14, a plurality of light emitting element chips may be disposed linearly in the right-left direction. The LED head 14 may cause each light emitting element to emit light with a light emission pattern that is based on an image data signal supplied from the controller 3 illustrated in FIG. 1.

A driving force may be supplied to the image forming main body 11 from an unillustrated motor. This may cause the first feeding roller 32, the second feeding roller 33, the developing roller 34, and the charging roller 37 to rotate in a direction of an arrow R1, i.e., in a clockwise direction in FIG. 2, and cause the photosensitive drum 36 to rotate in a direction of an arrow R2, i.e., in a counterclockwise direction in FIG. 2. Furthermore, the image forming main body 11 may electrically charge each of the first feeding roller 32, the second feeding roller 33, the developing roller 34, the developing blade 35, and the charging roller 37 by applying a predetermined bias voltage to each of the first feeding roller 32, the second feeding roller 33, the developing roller 34, the developing blade 35, and the charging roller 37.

Upon being electrically charged, the first feeding roller 32 and the second feeding roller 33 may each allow the developer in the developer containing space 31 to adhere to its peripheral side surface. The rotation of the first feeding roller 32 and the second feeding roller 33 may cause the developer to adhere to the peripheral side surface of the developing roller 34. The developing blade 35 may remove any excess developer from the peripheral side surface of the developing roller 34. In a state in which the developer has adhered to the developing roller 34 in a thin-film-like state, the peripheral side surface of the developing roller 34 may be brought into contact with the peripheral side surface of the photosensitive drum 36.

The charging roller 37 may electrically charge the peripheral side surface of the photosensitive drum 36 uniformly by coming into contact with the photosensitive drum 36 while being electrically charged. The LED head 14 may sequentially perform exposure on the photosensitive drum 36 by emitting light at a predetermined time interval with a light emission pattern that is based on the image data signal supplied from the controller 3 illustrated in FIG. 1. This may cause electrostatic latent images to be formed sequentially on the peripheral side surface of the photosensitive drum 36 in the vicinity of its upper end.

Thereafter, the photosensitive drum 36 may bring the portion with the electrostatic latent image into contact with the developing roller 34 by rotating in the direction of the arrow R2. This may cause the developer to adhere to the peripheral side surface of the photosensitive drum 36 in accordance with the electrostatic latent image, which may develop a developer image based on the image data. The photosensitive drum 36 may cause the developer image to reach the vicinity of a lower end of the photosensitive drum 36 by further rotating in the direction of the arrow R2.

An intermediate transfer section 40 may be disposed below the image forming units 10 in the housing 2, as illustrated in FIG. 1. The intermediate transfer section 40 may include a driving roller 41, a driven roller 42, a backup roller 43, an intermediate transfer belt 44, five primary transfer rollers 45, a secondary transfer roller 46, and a reverse bending roller 47. Of these components, the driving roller 41, the driven roller 42, the backup roller 43, the primary transfer rollers 45, the secondary transfer roller 46, and the reverse bending roller 47 may each have a columnar shape with its center axis extending in the right-left direction and may each be rotatably supported by the housing 2.

The driving roller 41 may be disposed at the lower back of the image forming unit 10S. The driving roller 41 may rotate in the direction of the arrow R1 in response to supply of a driving force from an unillustrated belt motor. The driven roller 42 may be disposed at the lower front of the image forming unit 10K. Upper ends of the driving roller 41 and the driven roller 42 may be positioned at approximately the same height as or slightly below the lower ends of the photosensitive drums 36 illustrated in FIG. 2 of the image forming units 10. The backup roller 43 may be disposed at a position that is at the lower front of the driving roller 41 and at the lower back of the driven roller 42.

The intermediate transfer belt 44 may be configured as an endless belt including a high-resistance plastic film. The intermediate transfer belt 44 may be so stretched as to circle around the driving roller 41, the driven roller 42, and the backup roller 43. Furthermore, the five primary transfer rollers 45 may be disposed in the intermediate transfer section 40 below a portion of the intermediate transfer belt 44 where the intermediate transfer belt 44 stretches between the driving roller 41 and the driven roller 42. In other words, the five primary transfer rollers 45 may be disposed in the intermediate transfer section 40 at positions that are below the respective image forming units 10 and that oppose the photosensitive drums 36 with the intermediate transfer belt 44 interposed therebetween. A predetermined bias voltage may be applied to each of the primary transfer rollers 45.

The secondary transfer roller 46 may be positioned below the backup roller 43. The secondary transfer roller 46 may be urged against the backup roller 43. In other words, in the intermediate transfer section 40, the intermediate transfer belt 44 may be pinched by the secondary transfer roller 46 and the backup roller 43. A predetermined bias voltage may be applied to the secondary transfer roller 46. In the following description, the secondary transfer roller 46 and the backup roller 43 may be collectively referred to as a secondary transfer section 49.

The reverse bending roller 47 may be disposed at a position that is at the lower front of the driving roller 41 and at the upper back of the backup roller 43. The reverse bending roller 47 may urge the intermediate transfer belt 44 in an upper front direction. This may keep the intermediate transfer belt 44 from sagging, and a tensile force may act on the intermediate transfer belt 44 between the rollers. A reverse bending backup roller 48 may be provided at the upper front of the reverse bending roller 47 with the intermediate transfer belt 44 interposed therebetween.

In the intermediate transfer section 40, a driving force supplied from an unillustrated belt motor may cause the driving roller 41 to rotate in the direction of the arrow R1. This may cause the intermediate transfer belt 44 to travel in a direction along an arrow E1. Each of the primary transfer rollers 45 may rotate in the direction of the arrow R1 with a predetermined bias voltage being applied thereto. The image forming units 10 may thereby transfer, onto the intermediate transfer belt 44, the developer images that have reached the lower ends of the peripheral side surfaces of the respective photosensitive drums 36 illustrated in FIG. 2, and sequentially superimpose the developer images of the respective colors on each other. At this point, the developer images of the respective colors may be superimposed on each other on the surface of the intermediate transfer belt 44 sequentially from silver (S) on the upstream side. The intermediate transfer section 40 may bring the toner images transferred from the respective image forming units 10 to the vicinity of the backup roller 43 by causing the intermediate transfer belt 44 to travel.

A conveyance path W may be provided inside the housing 2 illustrated in FIG. 1. The conveyance path W may be a maty along which the paper sheet P is to be conveyed. The conveyance path W may run in an upper front direction from a position that is at the front of the lower end in the housing 2, make approximately a half turn, and run in the back direction along the lower side of the intermediate transfer section 40. Thereafter, the conveyance path W may head in the upper direction, run in the upper direction on back side of the intermediate transfer section 40 and the image forming unit 10S, and head in the front direction. In other words, the conveyance path W may be shaped like an upper case English letter "S" in FIG. 1. Various components may be disposed along the conveyance path W inside the housing 2.

A first medium feeder 50 may be disposed in the vicinity of the lower end of the inside of the housing 2 illustrated in FIG. 1. The first medium feeder 50 may include, for example but not limited to, a medium cassette 51, a pickup roller 52, a feed roller 53, a retard roller 54, a conveyance guide 55, and conveyance roller pairs 56, 57, and 58. The pickup roller 52, the feed roller 53, the retard roller 54, and the conveyance roller pairs 56, 57, and 58 may each have a columnar shape having its center axis extending in the right-left direction.

The medium cassette 51 may have a hollow rectangular parallelepipedal shape. The medium cassette 51 may contain therein accumulated paper sheets P, i.e., paper sheets P stacked on top of each other with the sheet surfaces facing the upper-lower direction. The medium cassette 51 may be attachable to or detachable from the housing 2.

The pickup roller 52 may be in contact with the vicinity of the front end of the uppermost surface of the paper sheets P contained in the medium cassette 51. The feed roller 53 may be disposed at the front of the pickup roller 52 with a slight space provided therebetween. The retard roller 54 may be positioned below the feed roller 53. A gap of a size equivalent to the thickness of a single paper sheet P may be provided between the retard roller 54 and the feed roller 53.

In response to supply of a driving force from an unillustrated medium feeding motor, the first medium feeder 50 may cause the pickup roller 52, the feed roller 53, and the retard roller 54 to rotate or stop as appropriate. This may cause the pickup roller 52 to send out frontward one uppermost sheet or a plurality of upper sheets of the paper sheets P contained in the medium cassette 51. The feed roller 53 and the retard roller 54 may send out further frontward the uppermost sheet of the sheets P and stop the second and subsequent sheets. In this manner, the first medium feeder 50 may separate the paper sheets P from each other and send out each paper sheet P frontward.

The conveyance guide 55 may be disposed at a lower front portion in the conveyance path W. The conveyance guide 55 may cause the paper sheet P to travel in the upper front direction along the conveyance path W and further in the upper back direction. The conveyance roller pair 56 may be disposed near the middle of the conveyance guide 55, and the conveyance roller pair 57 may be disposed in the vicinity of the upper end of the conveyance guide 55. The conveyance roller pairs 56 and 57 may rotate in a predetermined direction in response to supply of a driving force from an unillustrated medium feeding motor. The conveyance roller pairs 56 and 57 may thereby cause the paper sheet P to travel along the conveyance path W. A second medium feeder 60 may be provided at the front of the conveyance roller pair 57 in the housing 2. The second medium feeder 60 may include, for example but not limited to, a medium tray 61, a pickup roller 62, a feed roller 63, and a retard roller 64. The medium tray 61 may have a plate-like shape that is thinner in the upper-lower direction. A paper sheet P2 may be placed on the upper side of the medium tray 61. Placed on the medium tray 61 may be a paper sheet P2 that differs from the paper sheet P contained in the medium cassette 51 in terms of the size and the material, for example.

The pickup roller 62, the feed roller 63, and the retard roller 64 may respectively have configurations similar to those of the pickup roller 52, the feed roller 53, and the retard roller 54 of the first medium feeder 50. In response to supply of a driving force from an unillustrated medium feeding motor, the second medium feeder 60 may cause the pickup roller 62, the feed roller 63, and the retard roller 64 to rotate or stop as appropriate. The second medium feeder 60 may thereby send out backward the lowermost sheet of the paper sheets P2 on the medium tray 61 and stop the second and subsequent sheets. The second medium feeder 60 may thus separate the paper sheets P2 from each other and send out each of the paper sheets P2 backward. The paper sheet P2 sent out at this point may be conveyed by the conveyance roller pair 57 in a similar manner to that of the paper sheet P along the conveyance path W. For the convenience of description, no distinction is made below between the paper sheet P2 and the paper sheet P, and they are simply referred to as a paper sheet P.

The rotation of the conveyance roller pair 57 may be restrained as appropriate to cause a frictional force to act on the paper sheet P. The conveyance roller pair 57 may thereby correct a so-called skew where the sides of the paper sheet P are inclined relative to the traveling direction and sent out backward the paper sheet P in a state in which the leading and trailing end sides are aligned in the right-left direction. The conveyance roller pair 58 may be disposed at a position that is at the back of the conveyance roller pair 57 with a predetermined gap provided therebetween. The conveyance roller pair 58 may rotate in a similar manner to, for example but not limited to, the conveyance roller pair 56. The conveyance roller pair 58 may thereby supply a driving force to the paper sheet P conveyed along the conveyance path W and cause the paper sheet P to travel further backward along the conveyance path W.

The secondary transfer section 49, i.e., the backup roller 43 and the secondary transfer roller 46, of the intermediate transfer section 40 described above may be disposed at the back of the conveyance roller pair 58. In the secondary transfer section 49, a developer image formed in the image forming unit 10 and transferred onto the intermediate transfer belt 44 may approach the secondary transfer section 49 along with the traveling of the intermediate transfer belt 44, and a predetermined bias voltage may be applied to the secondary transfer roller 46. Therefore, the secondary transfer section 49 may transfer the developer image from the intermediate transfer belt 44 onto the paper sheet P conveyed along the conveyance path W and cause the paper sheet P to travel further backward.

A fixing section 70 may be disposed at the back of the secondary transfer section 49. The fixing section 70 may include a heating section 71 and a pressure applying section 72. The heating section 71 and the pressure applying section 72 may be so disposed as to oppose each other with the conveyance path W interposed therebetween. In the heating section 71, a heater that generates heat and a plurality of rollers, for example, may be disposed on an inner side of a heating belt, which is a hollow endless belt. The pressure applying section 72 may have a columnar shape having its center axis extending in the right-left direction. The pressure applying section 72 may have its surface on the upper side pressed against a surface of the heating section 71 on its lower side to provide a nip portion.

Under the control of the controller 3, the fixing section 70 may raise the temperature of the heater in the heating section 71 to a predetermined temperature and cause the rollers to rotate as appropriate to allow for rotation and traveling of the heating belt in the direction of the arrow R1. The fixing section 70 may also cause the pressure applying section 72 to rotate in the direction of the arrow R2. Furthermore, upon receiving the paper sheet P onto which the developer image has been transferred by the secondary transfer section 49, the fixing section 70 may pinch, i.e., nip, the paper sheet P with the heating section 71 and the pressure applying section 72 and apply heat and pressure to the paper sheet P. The fixing section 70 may thereby fix the developer image to the paper sheet P and send out the paper sheet P backward.

A conveyance roller pair 74 may be disposed at the back of the fixing section 70. A switching section 75 may be disposed at the back of the conveyance roller pair 74. The switching section 75 may switch the traveling direction of the paper sheet P between the upper side and the lower side in accordance with the control of the controller 3. A medium discharge section 80 may be disposed over the switching section 75. The medium discharge section 80 may include, for example but not limited to, a conveyance guide 81 and conveyance roller pairs 82, 83, 84, and 85. The conveyance guide 81 may guide the paper sheet P upward along the conveyance path W. Rollers in each of the conveyance roller pairs 82, 83, 84, and 85 may oppose each other with the conveyance path W interposed therebetween.

A reconveyance section 90 may be disposed below, for example but not limited to, the switching section 75, the fixing section 70, and the secondary transfer section 49. The reconveyance section 90 may include, for example but not limited to, a conveyance guide providing a reconveyance path U and an unillustrated conveyance roller pair. The reconveyance path U may head downward from the lower side of the switching section 75, run frontward thereafter, and merge into the conveyance path W on downstream side of the conveyance roller pair 57.

In a case where the paper sheet P is to be discharged, the controller 3 may cause the switching section 75 to switch the traveling direction of the paper sheet P toward the medium discharge section 80 on the upper side. The medium discharge section 80 may convey the paper sheet P received from the switching section 75 upward and discharge the paper sheet P to a medium discharge tray 2T from a discharging slot 86. In a case where the paper sheet P is to be returned, the controller 3 may cause the switching section 75 to switch the traveling direction of the paper sheet P toward the reconveyance section 90 on the lower side. The reconveyance section 90 may convey the paper sheet P received from the switching section 75 to the reconveyance path U, bring the paper sheet P to the downstream side of the conveyance roller pair 57 thereafter, and reconvey the paper sheet P along the conveyance path W. In the image forming apparatus 1, the paper sheet P may be thereby returned to the conveyance path W with the sheet surfaces of the paper sheet P being flipped, which may allow for so-called duplex printing.

As described above, in the image forming apparatus 1, a developer image may be formed in the image forming unit 10 with the use of the developer D, and the developer image may be transferred onto the intermediate transfer belt 44. The developer image may be transferred onto the paper sheet P from the intermediate transfer belt 44 in the secondary transfer section 49. The developer image may be fixed to the paper sheet P in the fixing section 70. This may allow an image to be printed or formed on the paper sheet P.

2. Manufacture of Developer

Next, the manufacture of the developer D to be contained in the developer container 12 of the image forming unit 10 illustrated in FIG. 2 will be described. In the present example embodiment, manufacture of a silver developer D will be described as an example.

Typically, a developer D may include, for example but not limited to, a pigment directed to providing a desired color, a binder resin directed to binding the pigment to a medium such as the paper sheet P, and an external additive directed to improving the electrifiable property. For the convenience of description, in the following description, a particle including a pigment and a binder resin or a powdery substance that is a collection of such particles may be referred to as a toner or a toner particle, and a powdery substance that includes, for example but not limited to, an external additive in addition to the toner may be referred to as a developer D.

Furthermore, in the following description, a plurality of types of developers D that differ in terms of their configurations and characteristics were manufactured by changing, as appropriate, the conditions held at the time of manufacture. In the following description, the developers D manufactured in Example 1, Example 2, Example 3, Example 4, Comparative Example 1, and Comparative Example 2 are referred to as developers Da, Db, Dc, Dd, De, and Df, respectively.

2-1. Example 1

In Example 1, first, an aqueous medium in which an inorganic dispersant was dispersed was produced. Specifically, 920 parts by weight of industrial sodium phosphate tribasic dodecahydrate was mixed into 27000 parts by weight of pure water and dissolved at a liquid temperature of 60° C. Thereafter, dilute nitric acid for adjusting the hydrogen ion exponent (pH) was added to the solution. To this solution, a calcium chloride aqueous solution in which 440 parts by weight of industrial calcium chloride anhydrous was dissolved in 4500 parts by weight of pure water was introduced. The resultant was stirred by a line mill (available from PRIMIX Corporation, located in Hyogo, Japan) at a high speed for 34 minutes at a rotation speed of 3566 rpm with the liquid temperature kept at 60° C. Thereby, an aqueous phase including a suspension stabilizer, i.e., an inorganic dispersant, was adjusted.

Furthermore, in Example 1, a pigment-dispersed oily medium was produced. Specifically, 395 parts by weight of a brilliant pigment and 60 parts by weight of an electrification controlling agent (BONTRON E-84 available from Orient Chemical Industries Co., Ltd., located in Osaka, Japan) were mixed into 7430 parts by weight of ethyl acetate. Of the above, the brilliant pigment contained a fine thin piece of aluminum (Al), that is, a small piece of aluminum having a planar shape, a flat shape, or a scaly shape. The small piece of aluminum included in the brilliant pigment had a mode diameter in its volume particle size distribution of 10 μm and a degree of hydrophobization of 90. In the following description, this brilliant pigment is also referred to as an aluminum pigment, a metallic pigment, or a silver toner pigment.

Thereafter, the mixed liquid was heated to a liquid temperature of 50° C. and stirred. To this mixed liquid, 60 parts by weight of an electrification controlling resin (FCA-726N available from Fujikura Kasei Co., Ltd., located in Tokyo, Japan), 150 parts by weight of ester wax (WE-4 available from NOF CORPORATION, located in Tokyo, Japan), and 1310 parts by weight of polyester resin were introduced. Furthermore, the oil phase was adjusted by stirring this mixed liquid until no solid substance was present in the mixed liquid.

Thereafter, in Example 1, the oil phase was introduced into the aqueous phase maintained at a liquid temperature of 60° C. This was stirred for five minutes at a rotation speed of 1000 rpm to be suspended, and particles were formed thereby. Thereafter, ethyl acetate was removed through distillation under reduced pressure, and slurry including a toner was extracted thereby. Thereafter, nitric acid was added to the slurry and the resultant was stirred with the hydrogen ion exponent (pH) of no higher than 1.6. Tricalcium phosphate, which was a suspension stabilizer, was dissolved thereby in the above liquid, and this was dehydrated to extract the toner. Furthermore, the dehydrated toner was redispersed in pure water, stirred, and washed with water. Thereafter, a toner base particle was produced by performing sequentially the processes of dehydration, drying, and classification.

Now, the process of classifying the toner base particle will be further described. An Elbow-Jet Air Classifier (available from Nittetsu Mining Co., Ltd., located in Tokyo, Japan) was used in the classification process. As seen from a schematic configuration illustrated in FIG. 4, a classifier 100 may include a Coanda block 101, an F-edge 102 and an M-edge 103 that form a classification edge, a G-block 104, an intake edge 105, and an ejector 110.

A raw-material powder 120 to be classified may be introduced through a raw-material introduction slot 111 of the ejector 110 and sent into the classifier 100 along with compressed air 130 from an air introduction slot 112. Inside the classifier 100, particles of the raw-material powder 120 may be discharged through a discharging slot 113 and classified by means of the inertial force and the Coanda effect.

A rough powder 121, which is a relatively-large particle, of the raw-material powder 120 may be flown relatively far by the inertial force. A fine powder 122, which is a relatively-small particle, of the raw-material powder 120 may flow along the Coanda block 101 as a result of the Coanda effect. Furthermore, a medium powder 123, which is a medium-sized particle, of the raw-material powder 120 may be flown less far than the rough powder 121 and collected upon passing through a space between the F-edge 102 and the M-edge 103.

In Example 1, a distance from the Coanda block 101 to the leading end of the F-edge 102 in the classifier 100 was set to 15.0 mm. This distance is referred to below as an F-edge distance. The distance from the Coanda block 101 to the leading end of the M-edge 103 in the classifier 100 was set to 30.0 mm. This distance is referred to below as an M-edge distance. Furthermore, in the classifier 100, the toner base particle produced through the procedures described above was introduced through the raw-material introduction slot 111 as the raw-material powder 120, and the obtained medium powder 123 served as a toner, i.e., a particle including a pigment and a binder resin. Specifically, a toner having a volume median particle size of 15.4 μm was collected in Example 1.

Furthermore, in Example 1, the proportion of toner particles having a particle size of no more than 10 μm in the volume distribution of the toner was adjusted by varying each of the F-edge distance and the M-edge distance as appropriate. The toner particle having the particle size of no more than 10 μm is also referred to below as a fine powder or a fine particle.

Furthermore, in Example 1, an external additive process was performed on a toner. Specifically, 1.0 wt % of small silica (RY200 available from Nippon Aerosil Co., Ltd., located in Tokyo, Japan) and 1.5 wt % of colloidal silica (X24-9163A available from Shin-Etsu Chemical Co., Ltd., located in Tokyo, Japan) were introduced and mixed into the toner base particle. As a result, in Example 1, the developer Da having a volume median particle size of 15.4 μm and a proportion of toner particles, i.e., fine powder, having a particle size of no more than 10 μm in the volume distribution of 9.6% was obtained. The proportion of the toner particles having the particle size of no more than 10 μm in the volume distribution is referred to below as a fine powder proportion. The measurement of the volume median particle size and the measurement of the fine powder proportion will be described later.

2-2. Example 2

Figure 4:
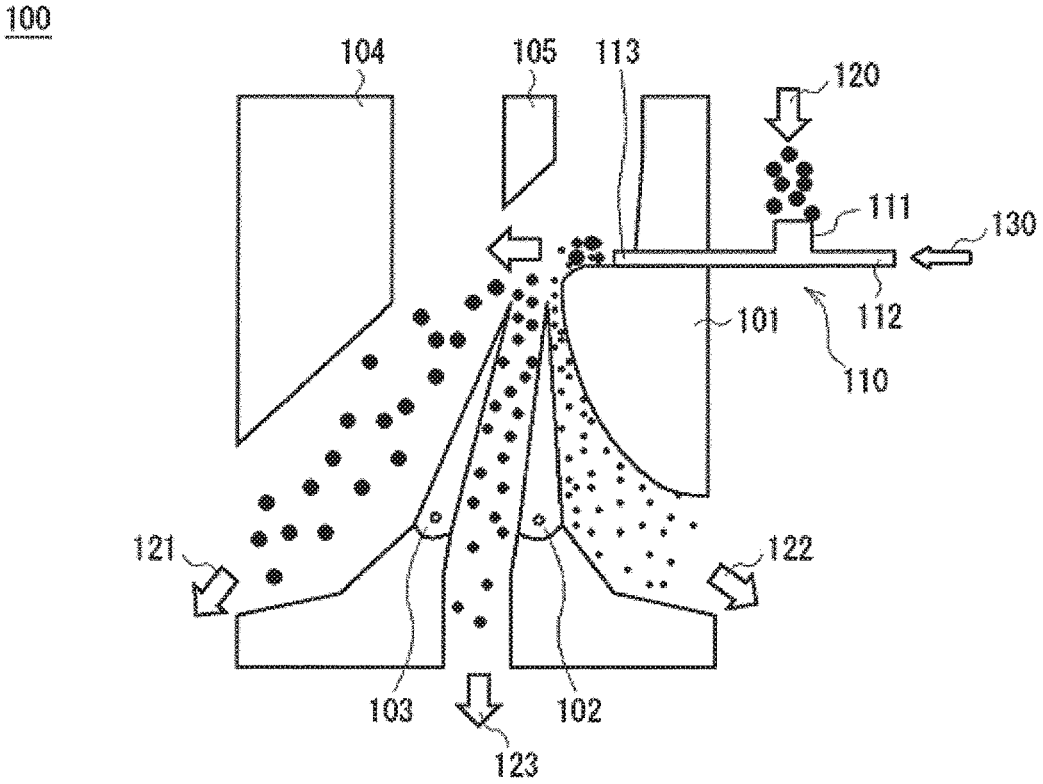
FIG. 4 is a schematic diagram illustrating an example of a configuration of a classifier.

In Example 2, a toner base particle was produced through procedures similar to those in Example 1, and a toner having a volume median particle size of 16.9 μm was collected by varying each of the F-edge distance and the M-edge distance as appropriate in the classifier 100, illustrated in FIG. 4, in the classification process. Furthermore, in Example 2, the developer Db having a fine powder proportion of 9.5% was obtained by performing an external additive process similar to that in Example 1.

2-3. Example 3

In Example 3, a toner base particle was produced through procedures similar to those in Example 1, and a toner having a volume median particle size of 15.9 μm was collected by varying each of the F-edge distance and the M-edge distance as appropriate in the classifier 100, illustrated in FIG. 4, in the classification process. Furthermore, in Example 3, the developer Dc having a fine powder proportion of 9.2% was obtained by performing an external additive process similar to that in Example 1.

2-4. Example 4

In Example 4, a toner base particle was produced through procedures similar to those in Example 1, and a toner having a volume median particle size of 16.1 μm was collected by varying each of the F-edge distance and the M-edge distance as appropriate in the classifier 100, illustrated in FIG. 4, in the classification process. Furthermore, in Example 4, the developer Dd having a fine powder proportion of 4.6% was obtained by performing an external additive process similar to that in Example 1.

2-5. Comparative Example 1

In Comparative Example 1, a toner base particle was produced through procedures similar to those in Example 1, and a toner having a volume median particle size of 14.4 μm was collected by varying each of the F-edge distance and the M-edge distance as appropriate in the classifier 100, illustrated in FIG. 4, in the classification process. Furthermore, in Comparative Example 1, the developer De having a fine powder proportion of 10.3% was obtained by performing an external additive process similar to that in Example 1.

2-6. Comparative Example 2

In Comparative Example 2, a toner base particle was produced through procedures similar to those in Example 1, and a toner having a volume median particle size of 18.7 μm was collected by varying each of the F-edge distance and the M-edge distance as appropriate in the classifier 100, illustrated in FIG. 4, in the classification process. Furthermore, in Comparative Example 2, the developer Df having a fine powder proportion of 2.0% was obtained by performing an external additive process similar to that in Example 1.

3. Measurement and Comparison of Developers

Next, the measurement and evaluation of the developers D, i.e., the developers Da, Db, Dc, Dd, De, and Df, will be described. The developers Da, Db, Dc, Dd, De, and Df are also referred to below as the developers Da to Df. With regard to the measurement of the developers D, the mode diameter, the volume median particle size (D50), the fine powder proportion, i.e., the proportion of toner particles having a particle size of no more than 10 μm in the volume distribution, the aluminum content, and the amount of electric charge were measured. With regard to the evaluation of the developers D, a predetermined image was printed on a paper sheet P by the image forming apparatus 1 illustrated in FIG. 1 with the use of the developer D, and fogging, streaking, and brilliance were evaluated.

3-1. Measurement of Mode Diameter

In the measurement, the volume particle size distribution and the mode particle size of each of the developers Da to Df were obtained. Specifically, in the measurement, first, 3 g of the developer D and 30 g of tetrahydrofuran (for high performance liquid chromatography (HPLC), available from Kanto Chemical Co., Inc., located in Tokyo, Japan) serving as a solvent were introduced into a beaker of a capacity of 100 ml. Thereafter, a stirrer was placed in the beaker, and the content was heated and stirred with the use of a digital hot stirrer (DP-1M, available from AS ONE Corporation, located in Osaka, Japan). In this example, the heating temperature was set to 60° C., the stirring time was set to 30 minutes, and the stirring speed was set to 340 rpm. The developer D were thereby dissolved in an organic solvent.

Furthermore, the solution was dropped into a glass funnel in which an ADVANCE filter paper having a diameter of 185 mm (available from AS ONE Corporation, located in Osaka, Japan) was placed to perform solid-liquid separation.

In the measurement, a residual substance mainly including a silver toner pigment was extracted by repeating the above procedure twice. Furthermore, in the measurement, the volume particle size distribution of the residual substance was created with the use of a precision particle size distribution measurement apparatus Multisizer 3 (available from Beckman Coulter, Inc., located in Tokyo, Japan), and the mode particle size was obtained. The volume particle size distribution is a distribution characteristic indicating frequency of each volume particle size of the particles included in the developer D. The mode particle size indicates the most frequently appearing particle size, that is, the mode value in the volume particle size distribution. The mode particle size is also referred to as a mode diameter. The measurement condition held in this case was equivalent to the measurement condition held when the volume median particle size and the fine powder proportion were measured as described later. Furthermore, the measurement was carried out in an environment where the temperature was 22° C. and the humidity was 50%.

The above procedures were performed on each of the developers Da to Df, and the mode particle size in the volume particle size was 10 μm as a result. In other words, the mode particle size of the silver toner mainly included in the developers Da to Df as the residual substance was 10 μm. Therefore, in the present example embodiment, of the particles included in the developer D, a particle having a particle size of no more than 10 μm, which is the mode particle size, may be defined as a "fine powder".

3-2. Measurement of Volume Median Particle Size and Fine Powder Proportion

In the measurement, the volume median particle size and the fine powder proportion of the developers D were measured with the use of a precision particle size distribution measurement apparatus Multisizer 3 (available from Beckman Coulter, Inc., located in Tokyo, Japan). The measurement conditions were as follows.

Aperture size: 100 μm

Electrolytic solution: ISOTON II (available from Beckman Coulter, Inc., located in Tokyo, Japan)

Dispersion solution: NEOGEN S-20F (available from DKS Co., Ltd., located in Kyoto, Japan) was dissolved in the above electrolytic solution, and the concentration was adjusted to 5%.

In the measurement, 10 mg to 20 mg of a measurement sample was added to 5 mL of the above dispersion solution and dispersed for one minute with the use of an ultrasonic dispersing machine. Thereafter, 25 mL of the electrolytic solution was added thereto and dispersed for five minutes with an ultrasonic dispersing machine. A coagulum was removed with the use of a mesh having a sieve opening of 75 μm, and a sample dispersion solution was adjusted.

Furthermore, in the measurement, this sample dispersion solution was added to 100 mL of the above electrolytic solution, and 30,000 particles therein were measured with the use of the aforementioned precision particle size distribution measurement apparatus to obtain the distribution, i.e., the volume particle size distribution. Thereafter, in the measurement, the volume median particle size (D50) and the fine powder proportion, i.e., the proportion of toner particles having a particle size of no more than 10 μm in the volume distribution, were obtained on the basis of the volume particle size distribution.

The volume median particle size (D50) refers to a particle size of a certain particle in a case where the number or the mass of the particles having particle sizes greater than the particle size of the certain particle occupy 50% of the number or the mass of the all particles in the particle size distribution of the powder substance. The aforementioned precision particle size distribution measurement apparatus may measure the particle size distribution through the Coulter principle. The Coulter principle is referred to as an aperture electric resistance technique. In this technique, a prescribed current is made to flow through an aperture in an electrolyte solution, and the volume of a particle is measured by measuring variation in the electric resistance in the aperture observed when the particle passes through the aperture.

Through the measurement, the measurement results summarized in the table in FIG. 5 were obtained for the volume median particle size and the fine powder proportion of each of the developers D, i.e., the developers Da to Df.

In addition to the above, in the measurement, an external additive was removed from each of the developers D, i.e., the developers Da to Df, through a removing process described below. In this removing process, first, pure water was added to a non-ionic surfactant, and this was stirred while being heated. The non-ionic surfactant was thereby dispersed in the pure water. The non-ionic surfactant may be, for example but not limited to, a polyoxyethylene alkyl ether. For the surfactant, EMULGEN 5% aqueous solution (available from Kao Corporation, located in Tokyo, Japan), for example, may also be used.

Thereafter, in the removing process, 100 mL (=$cm^3$) of the surfactant aqueous solution was introduced into a beaker containing 3 g of one of the developers Da to Df, and this surfactant aqueous solution was stirred for 40 minutes at a liquid temperature of 25° C. Furthermore, in the removing process, this beaker was placed in a water bath, and this water bath was vibrated at a temperature of 38° C. for 40 minutes with the use of an ultrasonic vibrator.

Thereafter, in the removing process, the surfactant aqueous solution was filtered by suction to collect a residue. Thereafter, in the removing process, the residue was washed sufficiently, and this residue was dried. This made it possible to remove the external additive from each of the developers Da to Df.

For the developers Da to Df from which the external additive was removed in the above described manner, the fine powder proportion was obtained through a similar method, and the measurement results summarized in FIG. 5 were obtained.

3-3. Measurement of Aluminum Content

In the measurement, the content of aluminum (Al) in each of the developers Da to Df was measured.

Typically, the amount of a pigment included in the developer D may often be defined in terms of the charged amount, i.e., the added amount, of the pigment in the process of manufacturing the developer D. However, not all of the pigment charged in the process of manufacturing the developer D may be incorporated into a toner, and there may be a pigment incorporated into a toner that is not collected in the classification process. Therefore, it may not be appropriate to define the amount of a pigment included in the developer D as its charged amount.

Furthermore, the proportion of a pigment with respect to a pigment dispersion solution produced by mixing ethyl acetate, a brilliant pigment, and an electrification controlling agent may differ from the proportion of the pigment with respect to a toner base particle held at the time of charging the pigment. Therefore, it may be difficult to define the amount of a pigment included in the developer D as its charged amount.

For these reasons, the amount of aluminum (Al) included in each of the developers Da to Df produced through the procedures described above was measured with the use of an energy dispersive fluorescence X-ray analyzing apparatus (EDX-800HS, available from Shimadzu Corporation, located in Kyoto, Japan).

Typically, when a sample is irradiated with an X-ray, a fluorescence X-ray, which is an X-ray unique to an atom included in the sample, may be generated and radiated from the sample. This fluorescence X-ray may have a wavelength, i.e., energy, specific to each element. Therefore, it may be possible to perform a qualitative analysis by examining the wavelength of the fluorescence X-ray.

Furthermore, the intensity of the fluorescence X-ray may be a function of the concentration. Therefore, it may be possible to perform a quantitative analysis by measuring the amount of X-rays for the respective wavelengths specific to the elements.

On the basis of such principles, with the use of the energy dispersive fluorescence X-ray analyzing apparatus, each of the developers Da to Df was irradiated with an X-ray radiated from an X-ray tube, and the content of aluminum (Al) in each of the developers Da to Df was measured on the basis of the fluorescence X-ray radiated from an aluminum (Al) atom included in corresponding one of the developers Da to Df. Furthermore, through a technique similar to the above, the content of aluminum (Al) in the fine powder was measured in a similar manner. In other words, the content of aluminum (Al) in particles, of the particles included in the developer D, that had a particle size of no more than 10 μm or the mode particle size was measured. The condition under which the energy dispersive fluorescence X-ray analyzing apparatus was used was set as follows.

Atmosphere: helium-substituted measurement

X-ray irradiation condition: voltage 15 kV, current 100 μA

Figures 6, 7:
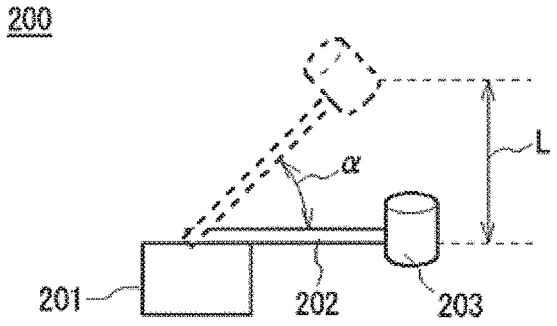
FIG. 6 is a table summarizing results from measuring an aluminum content in each developer and fine powder.
FIG. 7 is a schematic diagram illustrating an example of a configuration of a shaker.

Through the measurement, the measurement results summarized in FIG. 6 were obtained for the content of aluminum (Al) in each of the developers D, i.e., the developers Da to Df. In FIG. 6, the aluminum content is expressed in the percentage by volume of aluminum (Al) in each of the developers Da to Df.

Referring to the measurement results of the measurement illustrated in FIG. 6, the aluminum content in the fine powder is notably smaller that the aluminum content in the developers Da to Df. Specifically, whereas the aluminum contents in the developers Da to Df are from 7.019% to 21.473%, the aluminum content in the fine powder is 0.925%.

In other words, it can be appreciated that, unlike a toner particle, the fine powder includes almost no pigment, and a large portion of the fine powder is the binder resin. Accordingly, in the present example embodiment, of the particles included in the developer D, a particle satisfying both of a condition that a particle size is no more than 10 μm or the mode particle size, and a condition that an aluminum content is no more than 0.925% is referred to as a "fine powder".

It is inferred that this fine powder is produced because, when toner particles are produced from a binder resin and a metallic pigment, which is a fine thin piece of aluminum (Al), some particles have a particle size of no more than 10 μm, or the mode particle size of a silver toner pigment, and thus only the binder resin are provided as the particles without including almost any metallic pigment, for example.

3-4. Measurement of Amount of Electric Charge

In the measurement, the amount of electric charge in each of the developers Da to Df was measured. Specifically, in the measurement, 19 g of the developer D and 1 g of a carrier (N-1 available from The Imaging Society of Japan) were placed in a predetermined receptacle and mixed roughly. This was left for 24 hours or more in a room temperature environment where the temperature was 23° C. and the humidity was 50%, for example.

Thereafter, in the measurement, the mixture was shaken for 10 minutes with a shaker (YS-8D available from YAYOI, Co., Ltd., located in Tokyo, Japan) to produce a sample. FIG. 7 schematically illustrates a configuration of a shaker 200. In the shaker 200, a receptacle 203 may be attached to a main body 201 with an arm 202 interposed therebetween. The arm 202 and the receptacle 203 may pivot together about the main body 201. Furthermore, in the shaker 200, a shaking speed, a shaking angle α, and a shaking width L may each be set as the shaking condition held when the arm 202 is shaken. In this example, the shaking condition was set as follows.

Shaking speed: 120 times/minute

Shaking angle α: 0 to 45°

Shaking width L: 80 mm

Under this condition, in the measurement, the amount of electric charge in 0.2 g of the sample was measured with the use of a particle electric charge amount measuring device (210HS-2A available from TREK JAPAN KK, located in Tokyo, Japan). The amount of electric charge in each of the developers D, i.e., the developers Da to Df, obtained in the measurement is summarized in FIG. 5 along with the fine powder proportion and so on.

3-5. Evaluation of Fogging

In the evaluation, a printing process was performed with the developer D, i.e., any one of the developers Da to Df, contained in the developer container 12, illustrated in FIG. 2, of the image forming unit 10S corresponding to the special color in the image forming apparatus 1 illustrated in FIG. 1, and fogging was evaluated.

In the present example embodiment, a phenomenon in which the developer D adheres to a background portion of an image, that is, a non-image portion because of a developer D with a lower amount of electric charge than a normally-charged developer D or a developer D electrically charged in a reverse polarity is referred to as "fogging". Furthermore, in the present example embodiment, the developer D that induces such "fogging," that is, the developer D with a lower amount of electric charge or the developer D electrically charged in a reverse polarity is referred to as a "fogging developer".

Specifically, in the evaluation, with the use of the image forming apparatus 1, continuous printing was performed with an image pattern where the printing pixel density was 0.3% and with the drum count per day of 2000 until the guide drum count reached 4000.

The printing pixel density is a value representing the proportion of the number of pixels in which the developer D is transferred onto the paper sheet P with respect to the total number of pixels in a case where an image is divided on the basis of pixel unit. For example, printing with an area proportion of 100% in a case where entire surface solid printing is performed in a printable range of a predetermined region, e.g., a region corresponding to one cycle of a photosensitive drum or a region corresponding to one page of a print medium, may be described to have a printing image density of 100%. Printing corresponding to an area of 1% with respect to the printing image density of 100% may be described to have a printing image density of 1%. A printing pixel density DPD may be expressed as the following expression (1) with the use of a used dot number Cm, a rotation number Cd, and a total dot number CO.

$$DPD = \frac{Cm}{Cd \times CO} \times 100[\%] \quad (1)$$

The used dot number Cm may be the number of dots actually used to form an image while the photosensitive drum makes rotations Cd-times and is the total number of dots subjected to exposure by the LED head 14, illustrated in FIG. 2, while the image is formed. The total dot number CO is a total dot number per rotation of the photosensitive drum 36, illustrated in FIG. 2. In other words, the total dot number CO may be the total number of dots that is usable while the photosensitive drum 36 makes a single rotation regardless of whether the exposure is performed and that is potentially usable when an image is formed. In other words, the total dot number CO is the total value of the dot number used in a case where a solid image in which the developer D is transferred onto all of the pixels is formed. Therefore, the value (Cd×CO) may represent the total number of the dots potentially usable when an image is formed while the photosensitive drum 36 makes rotations Cd-times.

In the evaluation, after the continuous printing described above ended, a printing process of an image pattern having the printing pixel density of 0%, that is, an image in which the developer D was not used in any of the pixels was performed. This printing process was stopped during a developing process in the image forming unit 10S illustrated in FIG. 2, that is, in the middle of a process of transferring the developer D from the surface of the developing roller 34 onto the surface of the photosensitive drum 36.

Furthermore, in the evaluation, the developer D in "fogging" was sampled by affixing and peeling off an adhesive tape (Scotch mending tape available from Sumitomo 3M Limited, located in Tokyo, Japan) in a region 36A illustrated in FIG. 2. The region 36A was a region on the surface of the photosensitive drum 36 that is on the downstream side of a location where the photosensitive drum 36 came in contact with the developing roller 34 and on the upstream side of a location where the photosensitive drum 36 came in contact with the intermediate transfer belt 44. The aforementioned adhesive tape is referred to below as a sample adhesive tape.

Thereafter, in the evaluation, this sample adhesive tape was affixed to a white recording sheet (Excellent White A4, 70 kg paper, weighing 80 g/m$^2$ available from Oki Data Corporation, located in Tokyo, Japan), and an adhesive tape serving as a reference for comparison was affixed to another portion on the recording sheet. The adhesive tape serving as the reference for comparison is referred to below as a reference adhesive tape. Furthermore, in the evaluation, a hue difference ΔE (L*a*b color system chromaticity) of the sample adhesive tape and the reference adhesive tape was measured with the use of a spectral colorimeter (CM-2600d, measurement instrument φ=8 mm, available from Konica Minolta, Inc., located in Tokyo, Japan). The hue difference ΔE was calculated in accordance with the following expression (2).

$$\Delta E = (\Delta L^2 + \Delta a^2 + \Delta b^2)^{1/2} \quad (2)$$

In the evaluation, the developer D was sampled by the sample adhesive tape at a total of five positions on the photosensitive drum 36, the hue difference ΔE was measured in each sample, and the mean value was calculated. The five positions on the photosensitive drum 36 included the vicinities of the two ends in the main scanning direction, i.e., the right-left direction, and three positions that approximately equally divided the region between the two ends of the photosensitive drum 36 in the main scanning direction.

Furthermore, in the evaluation, a hue difference threshold TE was set to a value of 0.52, and the fogging was evaluated on the basis of a result of comparing the hue difference ΔE and the hue difference threshold TE. The obtained evaluation results are summarized in FIG. 5. Specifically, in the evaluation, a case where the hue difference ΔE was no higher than the hue difference threshold TE was given a high rating and indicated by a symbol "○ (circle)". Furthermore, in the evaluation, a case where the hue difference ΔE was higher than the hue difference threshold TE was given a low rating and indicated by a symbol "x (cross)".

3-6. Evaluation of Streaking

In the evaluation, a printing process was performed with the developer D, i.e., any one of the developers Da to Df, contained in the developer container 12, illustrated in FIG. 2, of the image forming unit 10S corresponding to the special color in the image forming apparatus 1 illustrated in FIG. 1, and streaking was evaluated. Streaking refers to a phenomenon in which the developer D is not fixed to a position where the developer D is supposed to be fixed when an image is formed on the paper sheet P.

Specifically, in the evaluation, after continuous printing similar to that performed in the evaluation of fogging was performed with the image forming apparatus 1, a printing process of an image pattern having the printing pixel density of 100%, that is, an image in which the developer D was used in all of the pixels, i.e., a so-called solid image, was performed. The paper sheet P on which the image was formed, i.e., the printing process was performed, was visually inspected to evaluate the presence of streaking.

At this point, in the evaluation, an occurrence of a vertical streak parallel to the traveling direction of the paper sheet P and a portion where the density changed at a cycle equivalent to the length of the outer periphery of the first feeding roller 32 and the second feeding roller 33, illustrated in FIG. 2, that is, a horizontal belt-shaped stripe pattern was determined through visual inspection. The evaluation results are summarized in FIG. 5. In the evaluation, a case where streaking occurred in no less than 1/10 of the printing region was given a low rating and indicated by the symbol "x (cross)". A case where the streaking occurred in less than 1/10 of the printing region was given a high rating and indicated by the symbol "○ (circle)".

3-7. Evaluation of Brilliance

In the evaluation, a printing process was performed with the developer D, i.e., any one of the developers Da to Df, contained in the developer container 12, illustrated in FIG. 2, of the image forming unit 10S corresponding to the special color in the image forming apparatus 1 illustrated in FIG. 1, and brilliance was evaluated.

Specifically, in the evaluation, with the use of coated paper (OS coated paper W 127/m$^2$ available from Fuji Xerox Co., Ltd., located in Tokyo, Japan) as the paper sheet P, a printing process of an image pattern having the printing pixel density of 100%, i.e., a so-called solid image, was performed with the image forming apparatus 1. In this case, the printing process was performed in the image forming apparatus 1 in a state in which the amount of the developer D to adhere to the photosensitive drum 36 of the image forming unit 10S, illustrated in FIG. 2, was adjusted to 1.0 mg/cm$^2$ by performing a predetermined operation of setting the printing condition.

Figure 8:
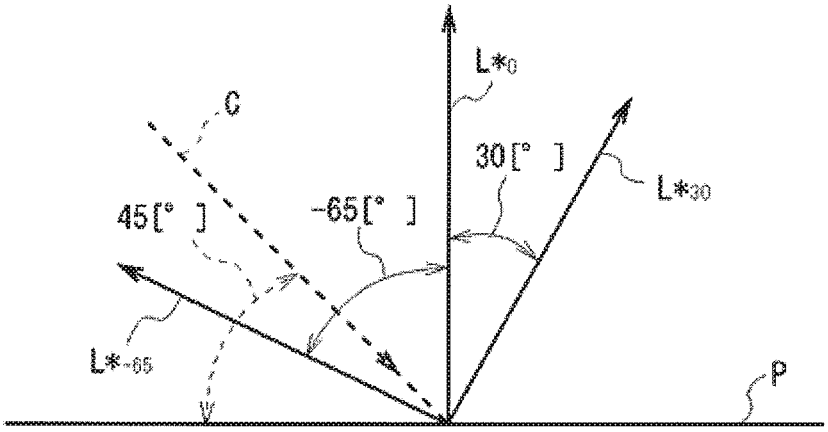
FIG. 8 is a schematic diagram illustrating an example of irradiation and reception of light by a goniophotometer.

Thereafter, in the evaluation, the brilliance was measured with the use of a goniophotometer (GC-5000L available from Nippon Denshoku Industries Co., Ltd., located in Tokyo, Japan). Specifically, as illustrated in FIG. 8, with the use of the goniophotometer, the paper sheet P was irradiated with a light ray C in a direction of 45° relative to the surface of the paper sheet P. The reflection light was received in a direction of 0°, a direction of 30°, and a direction of −65° relative to the vertical direction. A lightness index $L_{*0}$, a lightness index $L_{*30}$, and a lightness index $L_{*-65}$ were calculated on the basis of the results of the received light. Thereafter, in the evaluation, a flop index FI was calculated by substituting the calculated lightness indices into the following expression (3), and the brilliance of the image was measured.

$$FI = 2.69 \times \frac{(L_{*30} - L_{*-65})^{1.11}}{(L_{*0})^{0.86}} \tag{3}$$

A higher flop index FI indicates higher brilliance, and a lower flop index FI indicates lower brilliance. In the evaluation, metallic glossiness was produced in a printed material in a case where the flop index FI was no lower than 10, which led to an evaluation that the brilliance of the image was high. A metallic luster was not produced in a printed material in a case where the flop index FI was lower than 10, which led to an evaluation that the brilliance was low.

Furthermore, in the evaluation, the values of the calculated flop indices FI and the evaluation results are summarized in FIG. 5. In the evaluation results, a case where the flop index FI was no lower than 10 and a high rating was given was indicated by the symbol "0 (circle)". A case where the flop index FI was lower than 10 and a low rating was given was indicated by the symbol "x (cross)".

3-8. Determination of Fine Powder Proportion on Basis of Measurement and Evaluation Next, the condition for the fine powder proportion in the developer D was determined on the basis of the various measurement results and the various evaluation results illustrated in FIG. 6.

Specifically, in the present example embodiment, the developer De of Comparative Example 1 for which the evaluation on the fogging was low and the developer Df of Comparative Example 2 for which the evaluation on the streaking was low were excluded. Meanwhile, the developers Da to Dd of Examples 1 to 4 for which the evaluations on both the fogging and the streaking were high and the evaluation on the brilliance was high were adopted.

Accordingly, the condition of the fine powder proportion required for the developer D, that is, the condition of the proportion of toner particles having a particle size of no more than 10 μm in the volume distribution may be defined to a range that includes the values of the fine powder proportions in the developers Da to Dd and that excludes the values of the fine powder proportions in the developers De and Df. Specifically, the condition of the fine powder proportion required for the developer D was in a range equal to or higher than 4.6% and equal to or lower than 9.6% on the basis of the values in FIG. 5.

Furthermore, with regard to the developers Da to Dd, the condition of the fine powder proportion after the external additive was removed was in a range equal to or higher than 3.1% and equal to or lower than 9.6% on the basis of the values in FIG. 5 in a similar manner. Furthermore, the volume median particle size of the developers Da to Dd was in a range equal to or greater than 15.4 μm and equal to or smaller than 16.9 μm on the basis of the values in FIG. 5.

4. Example Effects, Etc.

In the image forming apparatus 1 illustrated in FIG. 1 according to the present example embodiment of the configuration described above, the silver developer D having brilliance may be contained in the developer container 12 illustrated in FIG. 2 of the image forming unit 10S. This makes it possible to express silver having brilliance in an image printed on the paper sheet P.

In the present example embodiment, the developer D may be produced with the use of a brilliant pigment containing a fine thin piece of aluminum (Al). This developer D may include a toner particle having a particle size of no more than 10 μm, which is the mode particle size in the volume particle size. In other words, the developer D may include a fine powder.

As illustrated in FIG. 6, the fine powder included in the developer D may have a very small aluminum (Al) content of 0.925%, and the ratio of aluminum (Al) to the resin may be about 0.01, which is very small. Therefore, it can be said that most of the fine powder is fine particles of the binder resin. In other words, the fine powder may contain almost no aluminum (Al) which is metal, and may be mostly the resin. Therefore, the fine powder may have a relatively-high electrifiable property and may be expected to have a function of increasing the electrifiable property in the developer D as with an electrifying agent.

The evaluation result of Comparative Example 2 indicates that, in a case where the fine powder proportion was at a relatively-low value of 2.0%, fogging occurred although streaking did not occur. Furthermore, the evaluation result of Comparative Example 1 indicates that, in a case where the fine powder proportion was at a relatively-high value of 10.3%, streaking occurred while an occurrence of fogging was suppressible. In contrast, the evaluation results of Example 1 to Example 4 indicate that high ratings in all of the fogging, the streaking, and the brilliance were obtained as long as the fine powder proportion was in a range equal to or higher than 4.6% and equal to or lower than 9.6%.

On the basis of the above, in the present example embodiment, the condition may be so set for the developer D as to include the developers Da to Dd for which a high rating was obtained in both the fogging and the streaking and as to exclude the developer Dd and the developer Df. Specifically, the developer D is to be produced under the condition that the fine powder proportion is in a range equal to or higher than 4.6% and equal to or lower than 9.6%. This condition is referred to below as a fine powder proportion condition.

Therefore, in the image forming apparatus 1, the use of the developer D that satisfies the fine powder proportion condition makes it possible to form a high-quality image that has no fogging, i.e., that has no developer D adhering to an unnecessary portion of the paper sheet P, that has no streaking, and that exhibits sufficient brilliance.

In other words, in the present example embodiment, since aluminum (Al) included in a toner particle in the developer D is metal, there is a possibility that the electrifiable property of the toner particle becomes insufficient; however, the fine powder included at an appropriate proportion makes it possible to increase the electrifiable property appropriately, which makes it possible to obtain a favorable printing result in the image forming apparatus 1.

Furthermore, in the present example embodiment, it is inferred that the fine powder included in the developer D includes particles of mostly the binder resin only whereas the metallic pigment has failed to be incorporated when the toner particle is produced from the metallic pigment, i.e., aluminum, and the binder resin, as described above. In other words, although the toner particle included in the developer D mainly include the metallic pigment and the binder resin, this binder resin and the binder resin included in the fine powder may be identical types of materials and share similar characteristics.

Therefore, in the present example embodiment, in a case where an image is to be formed on the paper sheet P by the image forming apparatus 1 with the use of the developer D, the toner particle and the fine powder may be highly compatible when heat and pressure are applied by the fixing section 70 illustrated in FIG. 1 to the developer image transferred onto the paper sheet P. Therefore, improved glossiness can be expected as compared to a case where another external additive is added.

Furthermore, in the present example embodiment, aluminum (Al) included in the brilliant pigment used when the developer D is produced may be shaped into a fine thin piece, that is, have a planar portion. When an image is formed on the paper sheet P with the use of the developer D in the image forming apparatus 1, the planar portion provided in an aluminum (Al) thin piece included in the developer D makes it possible to obtain higher brilliance.

According to the configuration described above, in the image forming apparatus 1 according to the present example embodiment, the developer D having brilliance may be contained in the developer container 12 of the image forming unit 10S. The developer D may be produced with the use of a brilliant pigment containing fine thin pieces of aluminum (Al). Furthermore, the developer D has a fine powder proportion in a range that is equal to or higher than 4.6% and equal to or lower than 9.6%. The fine powder proportion may be a proportion of toner particles, i.e., fine powder, having a particle size of no more than 10 μm, which is the mode particle size in the volume particle size. Therefore, the use of the developer D in the image forming apparatus 1 makes it possible to form a high-quality image on a paper sheet P with no fogging and with no streaking.

5. Other Embodiments

The foregoing example embodiment has been described referring to a case where aluminum (Al) included in the brilliant pigment used when the developer D is produced is a fine thin piece having a planar portion. The technology, however, is not limited thereto, and aluminum (Al) may be a small piece having various shapes such as a spherical shape or a rod-like shape, for example.

Further, the foregoing example embodiment has been described referring to a case where metal included in the brilliant pigment used when the developer D is produced is aluminum (Al). The technology, however, is not limited thereto, and various types of metal such as brass or an iron oxide may be used, for example. In this case, the color expressed by the developer when the developer is fixed to the paper sheet P may be a color based on the used metal.

The foregoing example embodiment has been described referring to a case where the range of the fine powder proportion in the developer D is defined to be equal to or higher than 4.6% and equal to or lower than 9.6% on the basis of the values measured with an external additive included. The technology, however, is not limited thereto, and the range may be defined to be equal to or higher than 3.1% and equal to or lower than 9.6% on the basis of the values measured with the external additive removed and on the basis of the description in FIG. 5, for example.

Further, the foregoing example embodiment has been described referring to a case where, of the particles included in the developer D, particles having an aluminum content of no higher than 0.925% is regarded as the fine powder is described. The technology, however, is not limited thereto, and a particle having an aluminum content of higher than 0.925% may be regarded as the fine powder. In this case, it suffices that the electrifiable property of the toner particle is enhanced by including the fine powder in the developer D.

Further, the foregoing example embodiment has been described referring to a case where the mode particle size is calculated by creating the volume particle size distribution of the particles included in the developer D on the basis of a residual substance extracted from the organic solvent in which the developer D is dissolved. The technology, however, is not limited thereto, and the mode particle size may be calculated through various other techniques.

Further, the foregoing example embodiment has been described referring to a case of a developer used in a single component development system. The technology, however, is not limited thereto, and one example embodiment may also be applied to a developer of a two component development method in which a carrier is used, for example.

Further, the foregoing example embodiment has been described referring to a case where five image forming units 10 are provided in the image forming apparatus 1 illustrated in FIG. 1. The technology, however, is not limited thereto, and the image forming apparatus 1 may include four or less image forming units 10 or six or more image forming units 10.

Further, the foregoing example embodiment has been described referring to a case where one example embodiment of the technology is applied to the image forming apparatus 1 that is a single function printer. The technology, however, is not limited thereto, and one embodiment of the technology may also be applied to an image forming apparatus having various other functions, including a multifunction peripheral (MFP) having functions of a copier and a facsimile device, for example.

Further, the foregoing example embodiment has been described referring to a case where the technology is applied to the image forming apparatus 1. The technology, however, is not limited thereto, and one embodiment of the technology may also be applied to various electronic devices such as a copier that form an image on a medium such as a paper sheet P, with the use of the developer D by an electrophotographic system.

Furthermore, the technology is not limited to the example embodiment and the other example embodiments described above. In other words, the technology also encompasses an embodiment obtained by combining, as desired, a portion or all of the example embodiment and the other example embodiments described above and an embodiment obtained by extracting a portion of the example embodiment and the other example embodiments described above.

Further, the foregoing example embodiment has been described referring to a case where the image forming unit 10 serving as an image forming unit includes the photosensitive drum 36 serving as a photosensitive member, the LED head 14 serving as an exposure unit, and the developing roller 34 serving as an developing member. The technology, however, is not limited thereto, and the image forming unit may include a photosensitive member, an exposure unit, and a developing member that each have various other configurations.

One embodiment of the technology is applicable to a case where an image is formed on a medium by an electrophotographic system with the use of a developer including a metallic pigment.

Furthermore, the technology encompasses any possible combination of some or all of the various embodiments and the modifications described herein and incorporated herein. It is possible to achieve at least the following configurations from the above-described example embodiments of the technology.

(1)

A developer including:

a metallic pigment; and a binder resin, in which the developer includes a fine powder having a particle size smaller than a mode value in a volume particle size distribution of the metallic pigment, and a proportion of the fine powder relative to the developer is equal to or higher than 4.6 percent and equal to or lower than 9.6 percent.

(2)

The developer according to (1), further including an external additive, in which a proportion of the fine powder relative to the developer in the volume particle size distribution held when the external additive is removed from the developer is equal to or higher than 3.1 percent and equal to or lower than 9.6 percent.

(3)

A developer including:

a metallic pigment;

a binder resin; and an external additive, in which the developer includes a fine powder having a particle size smaller than a mode value in a volume particle size distribution of the metallic pigment, and a proportion of the fine powder relative to the developer in the volume particle size distribution held when the external additive is removed from the developer is equal to or higher than 3.1 percent and equal to or lower than 9.6 percent.

(4)

The developer according to any one of (1) to (3), in which the metallic pigment includes a planar-shaped brilliant pigment.

(5)

The developer according to (4), in which the brilliant pigment includes an aluminum pigment.

(6)

The developer according to (5), in which a proportion of the aluminum pigment relative to the fine powder in percentage by volume is equal to or lower than 0.925 percent.

(7)

The developer according to any one of (1) to (6), in which the fine powder contains the binder resin.

(8)

The developer according to any one of (1) to (7), in which the mode value in the volume particle size distribution of the metallic pigment is calculated on the basis of a residual substance extracted from an organic solvent in which the developer is dissolved.

(9)

The developer according to any one of (1) to (8), in which the developer has a volume median particle size that is equal to or higher than 15.4 micrometers and equal to or lower than 16.9 micrometers.

(10)

An image forming unit including:

a photosensitive member that is subjected to exposure in response to light irradiation;

an exposure unit that performs exposure on the photosensitive member and thereby forms an electrostatic latent image; and a developing member that generates a developer image on the photosensitive member with use of the developer according to any one of claims 1 to 9, the developer image being based on the electrostatic latent image.

(11)

The image forming unit according to (10), further including a developer container that contains the developer, in which the developing member generates the developer image with use of the developer fed from the developer container.

(12)

An image forming apparatus including:

the image forming unit according to (10) or (11); and a fixing section that fixes the developer image generated by the image forming unit to a medium.

(13) A method of manufacturing a developer by a dissolution suspension method, the method including preparing a resin solution that causes at least a metallic pigment and a binder resin to be dispersed in an organic solvent, in which the developer includes a fine powder having a particle size smaller than a mode value in a volume particle size distribution of the metallic pigment, and a proportion of the fine powder relative to the developer is equal to or higher than 4.6 percent and equal to or lower than 9.6 percent.

(14) The method of manufacturing the developer according to (13), further including attaching an external additive to the developer, in which a proportion of the fine powder relative to the developer in the volume particle size distribution held when the external additive is removed from the developer is equal to or higher than 3.1 percent and equal to or lower than 9.6 percent.

According to one embodiment of the technology, it is possible to provide a developer that contains a metallic pigment but still allows for higher print quality, to provide an image forming unit and an image forming apparatus in which such a developer is used, and to provide a method of manufacturing such a developer.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A developer comprising:

a toner particle that includes a metallic pigment and a binder resin; and a fine powder particle that is separate from the toner particle, and that has a particle size equal to or smaller than a mode value calculated on a basis of a volume particle distribution of the metallic pigment, wherein a proportion of the fine powder particle relative to the developer, calculated on a basis of a volume particle size distribution of the developer, is equal to or higher than 4.6 percent and equal to or lower than 9.6 percent.

2. The developer according to claim 1, wherein the metallic pigment comprises a brilliant pigment.

3. The developer according to claim 2, wherein the brilliant pigment comprises an aluminum pigment.

4. The developer according to claim 3, wherein a proportion of the aluminum pigment relative to the fine powder particle in percentage by volume is equal to or lower than 0.925 percent.

5. The developer according to claim 1, wherein the fine powder particle contains the binder resin.

6. The developer according to claim 1, wherein the mode value in the volume particle size distribution of the metallic pigment is calculated on a basis of a residual substance extracted from an organic solvent in which the developer is dissolved.

7. The developer according to claim 1, wherein the developer has a volume median particle size that is equal to or higher than 15.4 micrometers and equal to or lower than 16.9 micrometers.

8. The developer according to claim 1, wherein the fine powder particle includes an external additive separate from the toner particle.

9. An image forming unit comprising:

a developer;

a developing member that carries the developer on a surface, wherein the developer includes:

a toner particle that includes a metallic pigment and a binder resin, and a fine powder particle that is separate from the toner particle, and that has a particle size equal to or smaller than a mode value calculated on a basis of a volume particle distribution of the metallic pigment; and a proportion of the fine powder particle relative to the developer, calculated on a basis of a volume particle size distribution of the developer, is equal to or higher than 4.6 percent and equal to or lower than 9.6 percent.

10. The image forming unit according to claim 9, wherein the metallic pigment comprises a brilliant pigment.

11. The image forming unit according to claim 9, further comprising a developer container that contains the developer, wherein the developing member generates the developer image with use of the developer fed from the developer container.

12. The image forming unit according to claim 11, wherein the developer container further comprises a carrier together with the developer.

13. The image forming unit according to claim 9, wherein the fine powder particle includes the binder resin.

14. The image forming unit according to claim 9, wherein the fine powder particle includes an external additive separate from the toner particle.

15. The image forming unit according to claim 9, wherein the mode value is calculated on a basis of a residual substance extracted from an organic solvent in which the developer is dissolved.

16. An image forming apparatus comprising:

the image forming unit according to claim 9; and a fixing unit that fixes a developer image formed by the image forming unit to a medium.

17. A developer container, comprising a developer;

a toner particle that includes a metallic pigment and a binder resin; and a fine powder particle that is separate from the toner particle and that has a particle size equal to or smaller than a mode value calculated on a basis of a volume particle distribution of the metallic pigment, wherein a proportion of the fine powder particle relative to the developer, calculated on a basis of a volume particle size distribution of the developer, is equal to or higher than 4.6 percent and equal to or lower than 9.6 percent.

18. The developer container according to claim 17, wherein the developer container further comprises a carrier together with the developer.

19. The developer container according to claim 17, wherein the fine powder particle includes an external additive separate from the toner particle.

20. The developer container according to claim 17, wherein the fine powder particle contains the binder resin.

* * * * *